US010882308B2

(12) United States Patent
Winters et al.

(10) Patent No.: US 10,882,308 B2
(45) Date of Patent: Jan. 5, 2021

(54) AIRFLOW FOR A MOTOR

(71) Applicant: Hewlett-Packard Development Company, L.P., Spring, TX (US)

(72) Inventors: William Winters, Sumner, WA (US); Robert Yraceburu, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 13 days.

(21) Appl. No.: 16/330,837

(22) PCT Filed: Sep. 8, 2016

(86) PCT No.: PCT/US2016/050626
§ 371 (c)(1),
(2) Date: Mar. 6, 2019

(87) PCT Pub. No.: WO2018/048401
PCT Pub. Date: Mar. 15, 2018

(65) Prior Publication Data

US 2019/0210358 A1 Jul. 11, 2019

(51) Int. Cl.
*B41J 11/00* (2006.01)
*B41F 23/04* (2006.01)
*B41J 29/377* (2006.01)

(52) U.S. Cl.
CPC ..... *B41F 23/0426* (2013.01); *B41F 23/0466* (2013.01); *B41J 11/002* (2013.01); *B41J 29/377* (2013.01)

(58) Field of Classification Search
CPC . B41F 23/0426; B41F 23/0466; B41J 11/002; B41J 29/377
See application file for complete search history.

(56) References Cited

U.S. PATENT DOCUMENTS

| | | | | |
|---|---|---|---|---|
| 4,851,017 | A | 7/1989 | Erickson et al. | |
| 5,875,562 | A | 3/1999 | Fogarty | |
| 6,463,674 | B1 * | 10/2002 | Meyers | B41J 11/002 34/304 |
| 6,892,642 | B2 | 5/2005 | De | |
| 8,458,924 | B2 | 6/2013 | Laube et al. | |
| 2002/0067401 | A1 | 6/2002 | Yraceburu | |
| 2005/0253912 | A1 * | 11/2005 | Smith | B41J 2/04586 347/102 |
| 2006/0143936 | A1 * | 7/2006 | Studebaker | F04D 29/541 34/90 |
| 2009/0244231 | A1 | 10/2009 | Tsuji et al. | |
| 2011/0199448 | A1 | 8/2011 | Kaiho et al. | |

FOREIGN PATENT DOCUMENTS

DE 19623303 A1 1/1997

* cited by examiner

*Primary Examiner* — Yaovi M Ameh
(74) *Attorney, Agent, or Firm* — Dicke Billig & Czaja PLLC

(57) ABSTRACT

An airflow device includes a motor to drive an impeller to cause a first airflow and a second airflow. A housing at least partially encloses the motor and impeller, and the housing defines at least a first path and a second path. Via the first path, the first airflow recirculates and is heated with the first path including a first wall with a nozzle array through which the first airflow passes to contact printed media passing external to the first wall. The second path receives a second airflow of air to travel alongside the motor and exit through a first port to join the first airflow at the impeller.

18 Claims, 4 Drawing Sheets

AIRFLOW FOR A MOTOR

BACKGROUND

The amount of information produced and accessed has increased exponentially. Similarly, the number and type of image formation devices, such as printers, has grown dramatically as well. In some image formation devices, an airflow device is used to dry printed media.

DETAILED DESCRIPTION

Figure 2:
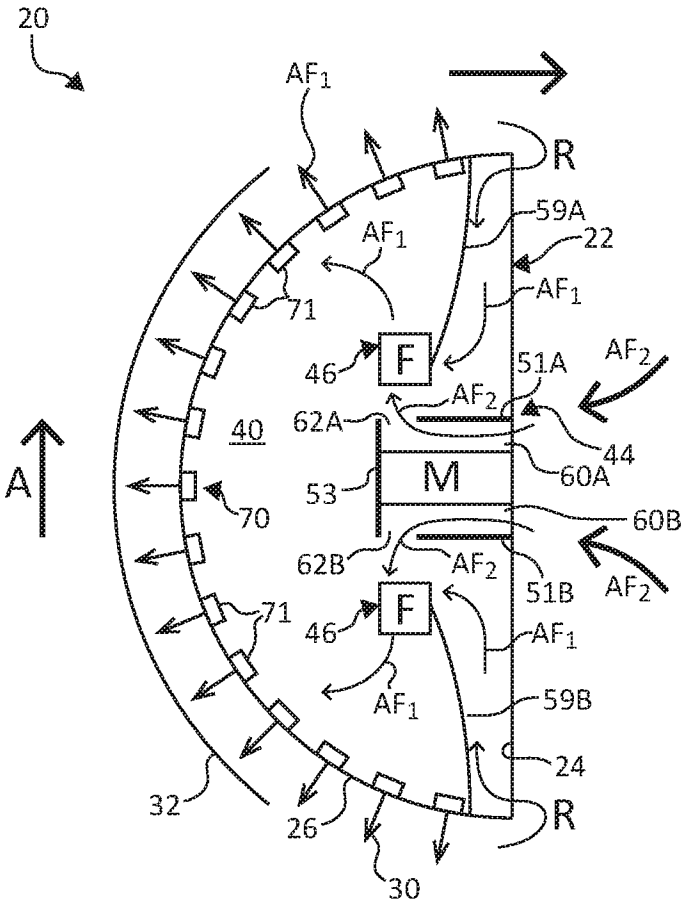
FIG. 2 is a diagram including a side view schematically representing an airflow device, according to one example of the present disclosure.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense. It is to be understood that features of the various examples described herein may be combined, in part or whole, with each other, unless specifically noted otherwise.

At least some examples of the present disclosure are directed to an airflow device to direct an airflow onto a media. In some examples, the airflow device comprises a dryer to direct a heated airflow onto a printed media. In some examples, the printed media comprises a media printed via an image formation mechanism, such as but not limited to, a fluid ejection assembly. In some examples, the fluid ejection assembly comprises an inkjet printing mechanism. In some examples, the airflow device is located just downstream along a media path from the image formation mechanism to expedite drying of the printed media.

In some examples, an airflow device comprises a housing and a motor to drive an impeller to cause a first airflow and a second airflow. The housing at least partially encloses the motor and impeller. The housing defines at least a first path and a second path. The first path recirculates the first airflow in a first temperature range above an ambient temperature. The second path receives the second airflow, at the ambient temperature, to travel alongside the motor and exit through at least one port to join the first airflow at the impeller. In some examples, this second airflow may sometimes be referred to as cooling the motor, e.g. convectively transferring heat away from the motor. It will be understood that in joining the first airflow, the second airflow may sometimes be referred to as becoming incorporated within the first airflow.

In some examples, a first wall is located along the first path with the first wall including a nozzle array through which the first airflow is forced (via the impeller) to contact printed media passing external to the first wall before the first airflow recirculates toward the impeller via remaining portions of the first path.

In some examples, the ambient temperature may refer to a temperature of the air in the ambient environment external to at least the airflow device. This ambient environment may include and/or be within an image formation device, such as a printer. In some examples, the ambient environment within the image formation device may be in fluid communication with the ambient environment external to the image formation device. In some examples, the ambient temperature may refer to a temperature of the air in the ambient environment external to the image formation device. In some examples, the air temperature generally within the image formation device (but external to the airflow device) is generally the same as the air temperature of the ambient environment external to the image formation device.

In some examples, the housing of the airflow device comprises a first portion to at least partially enclose the impeller and to direct the first airflow. In some examples, the housing comprises a second portion to at least partially enclose the motor and to direct the second airflow. In some examples, a second wall is common to both the first portion and the second portion, with the second wall acting to maintain separation between the first airflow and the second airflow. The second wall includes at least one port positioned to permit the second airflow to join the first airflow at the impeller after the second airflow has passed along the motor, e.g. has cooled the motor.

In some examples, the airflow device comprises a single motor. In some examples, the airflow device comprises a single impeller driven by the single motor. Stated differently, in some examples, there are no impellers and/or no motors used for cooling in addition to the above-described single impeller and single motor.

In some examples, the second portion of the housing at least partially encloses the motor in a manner in which the motor does not protrude beyond a plane through which a back wall of the housing extends. In some examples, the second portion comprises a recess to at least partially enclose the motor. In some examples, the recess has a depth (e.g. length) equal to or greater than a length of the motor. In some examples, the recess has a depth less than a length of the motor. In one aspect, this arrangement provides a space-saving, compact design.

In some examples, via the recess of the second portion, the motor is also recessed relative to the fins of the impeller. In particular, in some examples, the motor is located centrally within an interior space defined by an inner edge of the impeller and is spaced apart from an inner edge of the impeller. In this position, in some examples a length of the motor is generally co-extensive with at least a majority of a length of the respective fins of the impeller. In one aspect, this arrangement provides a space-saving, compact design.

Via at least some of the above-described arrangements, an airflow device may help dry printed media via recirculating, heated air while still convectively cooling a motor via a separate airflow at a temperature substantially less than the recirculating, heated air. In at least some instances, this arrangement may promote longevity of the motor and/or enhance efficiency and effectiveness of the motor. In at least some instances, this arrangement may help to avoid the use of a larger and/or more expensive motor than might otherwise be used in the absence of the airflow device of the examples of the present disclosure.

These examples, and additional examples, are described in association with at least FIGS. 1-6.

Figure 1:
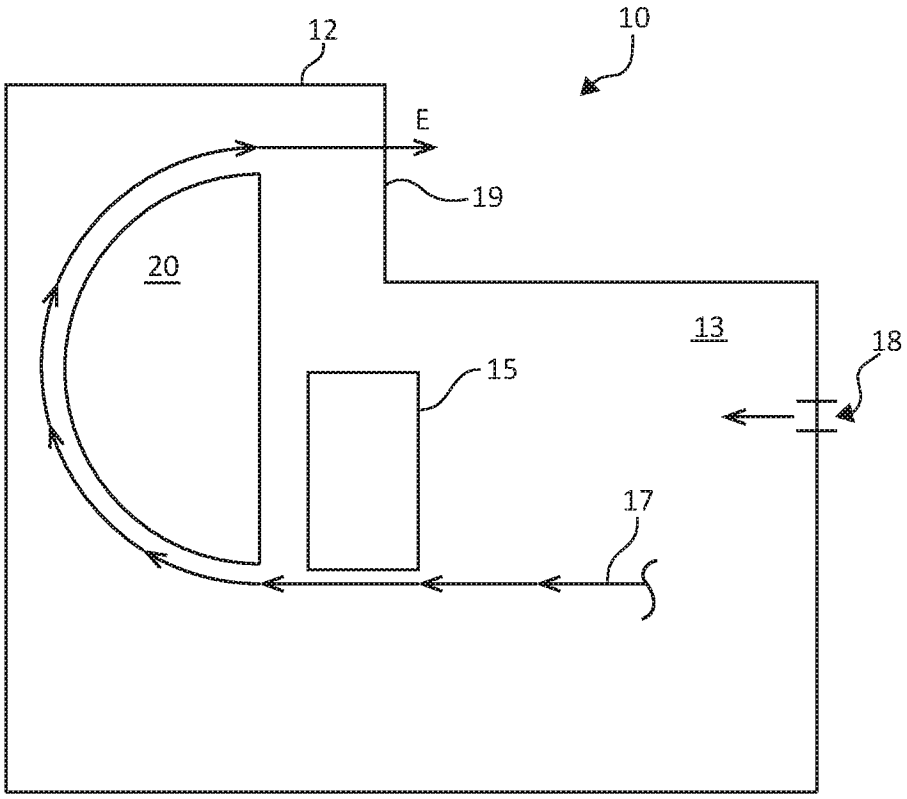
FIG. 1 is a diagram including a side view schematically representing an image formation device, according to one example of the present disclosure.

FIG. 1 is a diagram schematically representing an image formation device 10, according to one example of the present disclosure. As shown in FIG. 1, the image formation device 10 includes a housing 12 at least partially enclosing an image formation mechanism 15 to form images on a media traveling along a media path 17. In some examples, the image formation device 10 comprises an airflow device 20, which in some instances may be a dryer. In some examples, the airflow device 20 is located just downstream along the media path 17 from the image formation mechanism 15 to expedite drying of the media and images formed thereon via image formation mechanism 15 before the media leaves the device 10 at exit 19 (as represented via directional arrow E).

In some examples, the image formation mechanism 15 comprises a fluid ejection assembly. In some examples, the fluid ejection assembly comprises an inkjet printing mechanism. In some examples, the inkjet printing mechanism comprises a page wide array of inkjet printheads, which may sometimes be referred to as a printbar.

While not shown for illustrative simplicity, it will be understood that in some examples, the media path 17 may include additional segments prior to that shown in FIG. 1 and that the interior 13 of the image formation device 10 may include additional components. In some examples, the housing 12 of image formation device 10 includes at least one inlet 18 through which ambient air may be drawn into the interior 13 of the housing 12. In some examples, the housing 12 includes multiple air inlets 18. It will be further understood that air may leave or enter the interior 13 of housing 12 via the exit 19 through which a media exits the device 10. It will be further understood that in some examples, the device 10 may include additional pathways or ports to permit air to flow out of device 10.

FIG. 2 is diagram including a side view schematically representing an air flow device 20, according to one example of the present disclosure. In some examples, the air flow device 20 comprises at least some of substantially the same features and attributes as the air flow device 20 of FIG. 1. In some examples, the air flow device in FIG. 2 provides one example implementation of the air flow device 20 in the arrangement of FIG. 1.

As shown in FIG. 2, an airflow device 20 comprises a housing 22, which at least partially encloses a motor M and an impeller 46 driven by the motor M to cause a first airflow AF1 and a second airflow AF2. At least the fins F of impeller 46 are schematically represented in FIG. 2 via reference indicators F.

In some examples, the housing 22 defines at least a first portion 40, which provides a first path to recirculate the first airflow in a first temperature range above an ambient temperature. In some examples, the first temperature range comprises a temperature 5 to 50 degrees Celsius greater than an ambient temperature, which is on the order of 40 to 70 degrees Celsius. In some example, the first temperature range includes temperatures greater than 50 degrees Celsius more than the ambient temperature.

In some examples, the first temperature range comprises a temperature of 10 to 40 degrees Celsius greater than an ambient temperature, which is on the order of 40 to 70 degrees Celsius. In some examples, the first temperature range comprises a temperature of 20 to 30 degrees Celsius greater than an ambient temperature, which is on the order of 40 to 70 degrees Celsius.

In some examples, the first temperature range comprises a temperature at least 30 degrees Celsius greater than an ambient temperature, which is on the order of 40 to 70 degrees Celsius.

In one aspect, the temperatures within the first temperature range are substantially greater than the ambient temperature. In some examples, the term substantially greater may refer to a difference on the order of 1.5×, 2×, 3×, 4×, or 5× greater than the ambient temperature. In some examples, the term substantially greater may refer to a difference on the order of more than 5× greater than the ambient temperature. In some examples, the term substantially greater may refer to a difference which is an order of magnitude greater than the ambient temperature.

It will be understood in this context that, in at least some examples, the ambient temperature is an absolute temperature in the sense that it may be a measurable temperature and the temperature (or temperature range) of the first airflow (AF1) represents a temperature which is relative to the measured temperature of the ambient air.

In some examples, the housing 22 defines at least a second portion 44, which at least partially encloses the motor M. The second portion 44 provides a second path to receive the second airflow AF2, at the ambient temperature, to travel alongside the motor M and then exit through at least one port 62A, 62B to join the first airflow AF1 adjacent the fins F of impeller 46. Accordingly, in some examples, the second airflow AF2 may sometimes be referred to as a non-heated airflow, an ambient airflow, or an airflow at an ambient temperature.

In some examples, the second airflow AF2 is separate from, and independent of, the first airflow AF1. This separation is maintained via wall 51A, 51B of second portion 44 of housing 22, with the at least one exit port 62A, 62B permitting second airflow AF2 to join or become part of first airflow AF1 outside the second portion 44 at or near the fins F of impeller 46.

In some examples, the second path through which the second airflow AF2 passes includes gap 60A, 60B between wall 51A, 51B and the sides of motor M.

In some examples, the first airflow AF1 is a heated airflow, which is further described later in association with at least FIG. 6, such that first portion 40 includes a heater. In some examples, the second airflow AF2 is a non-heated airflow with second portion 44 excluding a heater.

In some examples, the first portion 40 of the housing 22 comprises a first wall 26 including an array 70 of nozzles 71 (e.g. apertures) through which the first airflow AF1 (having incorporated the second airflow AF2) is forced via the impeller 46 to contact printed media 32 passing external to the first wall 26. After contact with media 32, the first airflow AF1 recirculates toward the impeller 46 via remaining portions of the first path defined by first portion 40 of housing 22. In some examples, such remaining portions of the first path may include walls 59A, 59B, respectively which separate returning portions of the first airflow AF1 from portions of the first airflow AF1 just exiting the impeller 46. At least some aspects of this recirculation are further described later in association with at least FIG. 3 and FIG. 6. As shown in FIG. 2, at least some aspects of this recirculation are represented generally via directional arrow R.

Via the centrifugal action of the impeller F, positive pressure drives the first airflow AF1 to move through the nozzle array 70. In one aspect, the impeller 46 acts as centrifugal pump to create positive pressure downstream from the fins F of impeller 46 and to create slight negative pressure upstream from the fins F of impeller 46, such as in or near the second portion 44 (which at least partially encloses motor M). In some examples, this negative pressure is present within or near the at least one exit port 62A, 62B, which in turn draws ambient air through second portion 44 of housing 22 and alongside the motor M to relatively cool the motor M. At least some of these aspects will be described later in more detail in association with at least FIGS. 3-6.

In some examples, the first wall 26 defines a 180 degree arc along media path 17 such that the drying first airflow AF1 (30) contacts the media as the media makes a 180 degree turn within the housing 12 of the image formation device. In one aspect, this arrangement increases the amount of time which the printed media remains exposed to the drying airflow AF1 of airflow device 20.

In some examples, the motor M comprises the sole motor of the airflow device 20. In some examples, the impeller 46 comprises the sole impeller of the airflow device 20. In some examples, the impeller 46 does not take power from a motor other than motor M of airflow device 20.

In some examples, to the extent that a combination of the motor and the impeller may sometimes be referred to as a fan, this fan comprises the sole fan of the airflow device 20. In some examples, the airflow device 20 comprises the sole airflow device of the image formation device 10 directed to drying a printed media. In some examples, the airflow device 20 comprises the sole active airflow device of an image formation device 10.

It will be understood that in some examples, the impeller 46 and motor M may be configured as an axial blower rather than a centrifugal pump while still drawing a second airflow AF2 alongside the motor M of the axial blower separately (via a separation wall 51A, 51B) from a recirculating, heated first airflow AF1 before permitting the second airflow AF2 to later join and/or become part of the first airflow AF1.

In addition, it will be further understood that in at least some examples the representation of first and second airflows refer primarily to a source and path of airflows through a housing, including a representation of when, where, and/or how the respective airflows are separate and/or become joined together. In doing so, this representation of first and second airflows does not purport to provide a strict accounting for the addition and/or subtraction of all air volumes relating to airflow device 20 and relating to an image formation device 10 as a whole. For instance, after air exits the nozzles 70 at first wall 26, some of this exiting air is not recovered for recirculation as part of first airflow AF1. Instead, some of the air which exits nozzles 70 may travel elsewhere within an image formation device 10 (FIG. 1) and/or exit the image formation device 10. Accordingly, it will be understood that in at least some examples of the present disclosure, the respective first and second airflows AF1, AF2 relate to each other in a complementary manner without attempting to account for every aspect of air flows relating airflow device 20 and/or an image formation device 10.

Figure 3:
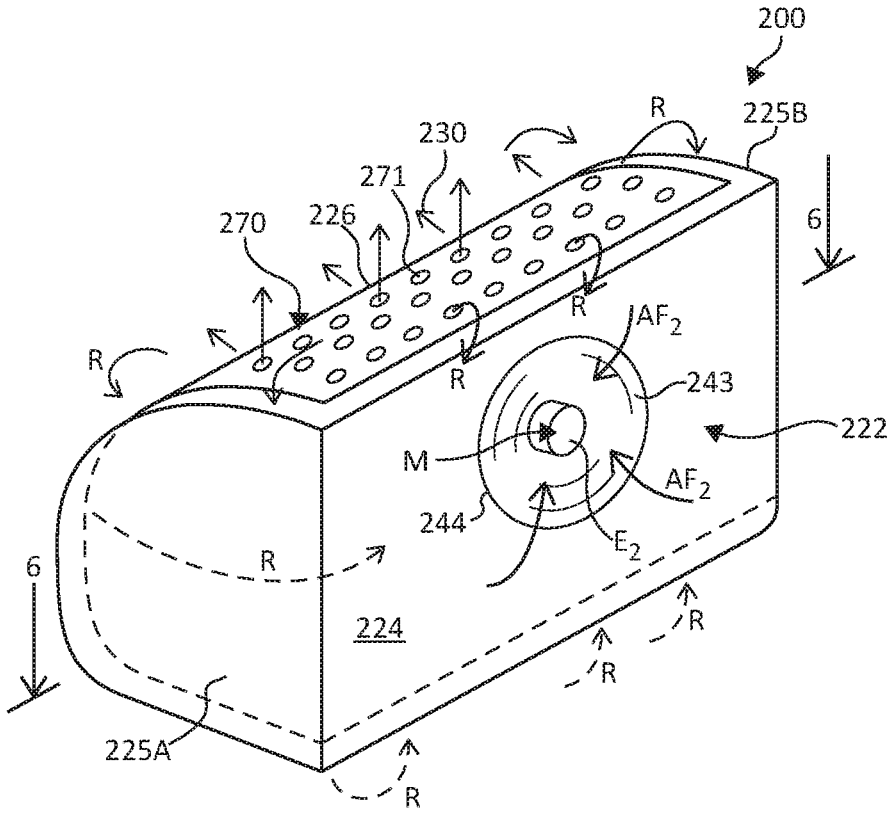
FIG. 3 is a diagram including a perspective view schematically representing an airflow device, according to one example of the present disclosure.

FIG. 3 is a diagram including a perspective view schematically representing an airflow device 200, according to one example of the present disclosure. In some examples, airflow device 200 comprises at least some of substantially the same features and attributes as airflow device 20 in FIGS. 1 and 2. In some examples, airflow device 200 comprises one example implementation of airflow device 20 of FIGS. 1-2. As such, similar reference numerals may refer to similar elements.

As shown in FIG. 3, airflow device 200 includes a housing 222 comprising a first wall 226 and a second wall 224 and end portions 225A, 225B. The first wall 226 includes an array 270 of nozzles 271 (e.g. apertures) to direct a first airflow AF1 outwardly to contact a printed media. After contacting the media 32, the first airflow AF1 is recirculated via a return path, as represented via directional arrows R. In some examples, end portions 225A, 225B of housing 222 at least partially define the return path to recirculate first airflow AF1. Accordingly, the end portions 225A, 225B are sized and/or shaped to receive airflow AF1 and direct that airflow back into an interior of housing 222. At least some detailed aspects of this arrangement are further described later in association with FIG. 6.

It will be understood that in at least some examples, some of the recirculation paths (such as at top edge of back wall 224) may be omitted, while other recirculation paths may be added. The number, orientation, and configuration of recirculation paths may take a variety of forms and may be located in a variety of positions about housing 222.

As further shown in FIG. 3, in some examples, second wall 224 of housing 222 includes a second portion 244, which at least partially encloses motor M, an end E2 of which is shown protruding. In some examples, second portion 244 comprises a mouth 243 to facilitate drawing a second airflow AF2 of ambient air (external to housing 222) into the second portion 244 and alongside motor M to thereby convectively cool motor M. In some examples, mouth 243 at least partially defines a concave-shaped surface relative to the back wall 224 of the housing 222. In some examples, the mouth 243 may define a vortex. In some examples, the mouth 243 may define a convex vortex. It will be understood that the mouth 243 may take a variety of forms and shapes provided that they facilitate or at least do not hinder air flow into second portion 244 for travel alongside motor M as second airflow AF2.

As previously noted in association with FIG. 1 and as later described in association with FIG. 6, the direct exposure of motor M to second airflow AF2 based on the relative isolation of the motor M from at least the fins F of the impeller (e.g. 46 in FIG. 3) may enhance cooling of motor M while still allowing recirculation of heated air via the interior of the housing 222 to dry printed media 32 (FIG. 2).

Figure 4A:
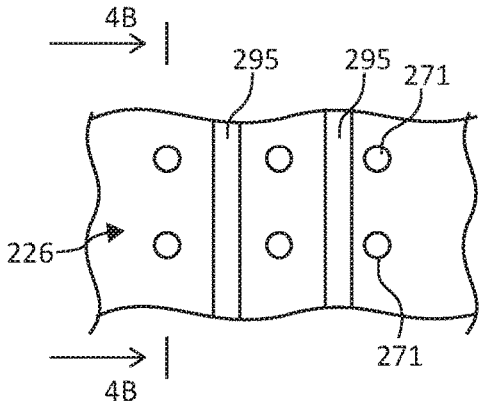
FIG. 4A is a diagram including a partial plan view of an exterior surface of an airflow device, according to one example of the present disclosure.
Figure 4B:
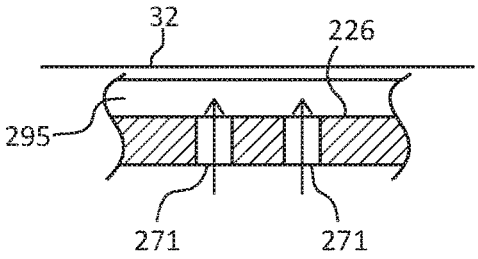
FIG. 4B is a diagram including a sectional view as taken along lines 4B-4B of FIG. 4A, according to one example of the present disclosure.

FIG. 4A is a diagram including a partial plan view of an exterior surface of an airflow device, according to one example of the present disclosure. As shown in FIG. 4A, in some examples the first wall 226 includes multiple ribs 295 between and/or among the nozzles 271 to help maintain spacing between a media and the nozzles 271 to thereby facilitate direction of heated airflow AF1 onto the passing media 32 and to facilitate advancement of the media 32 along the first wall 226, as further shown in the sectional view of FIG. 4B.

Figure 5:
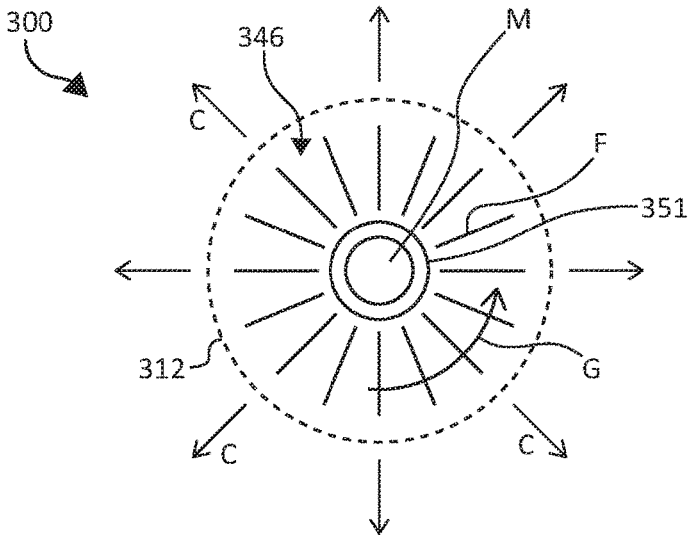
FIG. 5 is a diagram including a plan view of a motor and impeller of an airflow device, according to one example of the present disclosure.

As shown in the plan view of FIG. 5, in some examples the motor and impeller of the airflow device (20 in FIGS. 1-2; 200 in FIG. 3; 400 in FIG. 6) may take the form of a centrifugal air pump 300, according to one example of the present disclosure. As shown in FIG. 5, an impeller 346, which includes an array of fins F, is rotationally driven (G) by a motor M to produce an airflow C oriented radially outward. A wall 351 is interposed between, and separates, the motor M from the fins F of impeller 346. The wall 351 is radially spaced apart from motor M and from the fins F of impeller 346. In some instances, the wall 351 may sometimes be referred to as being concentrically arranged between the motor M and the fins F of impeller 346. As further described in several examples of the present disclosure, the wall maintains separation between a recirculating, heated first airflow AF1 and a second airflow AF2 for convectively cooling motor M.

Figure 6:
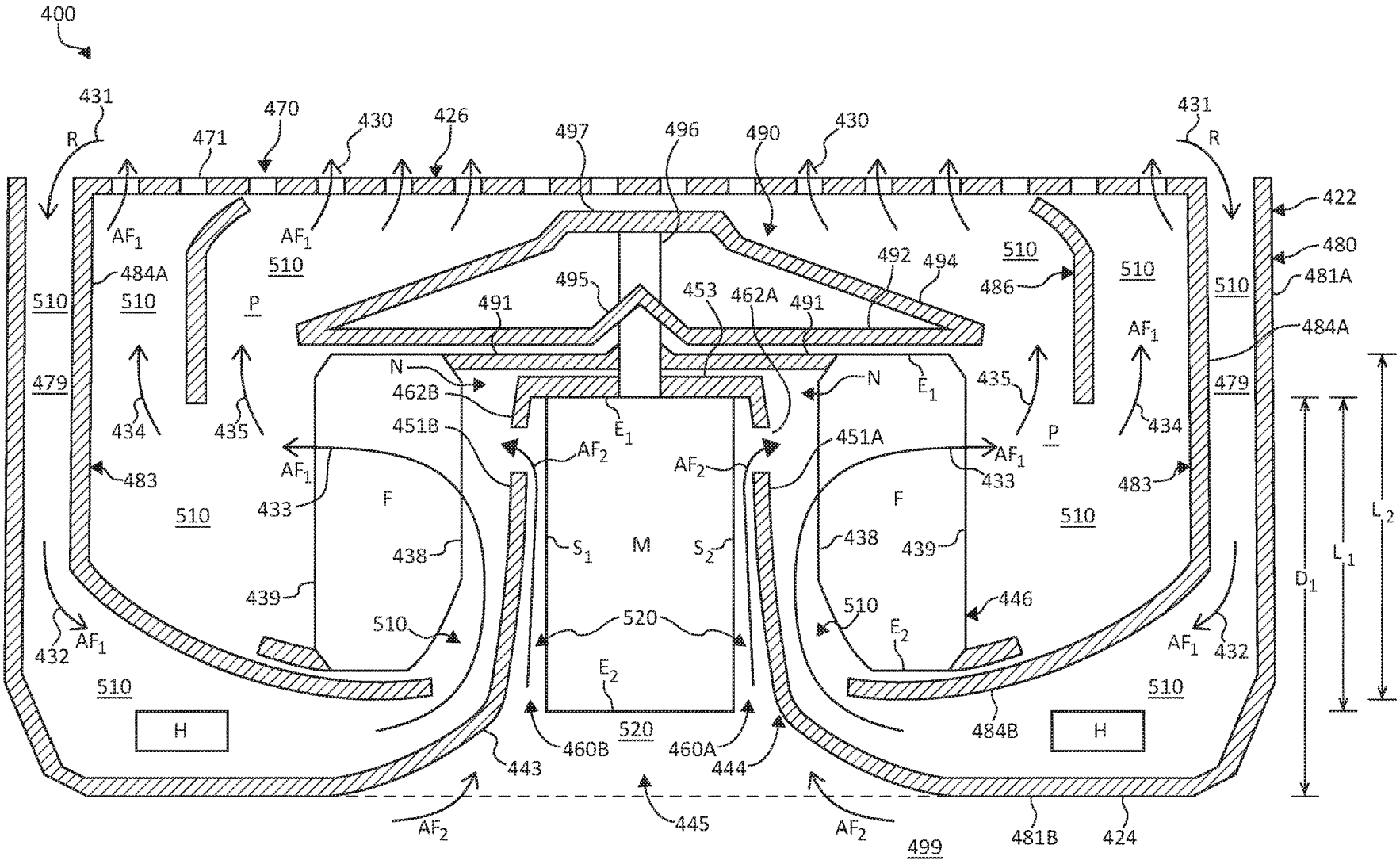
FIG. 6 is a diagram including a sectional view as taken along lines 6-6 of FIG. 3, according to one example of the present disclosure.

While FIG. 5 depicts motor M and impeller 346 as enclosed within a housing (represented via dashed lines 312), it will be understood that in some examples, other housing arrangements may be used such as depicted in at least FIGS. 1, 3, and 6.

FIG. 6 is a diagram including a sectional view as taken along lines 6-6 of FIG. 3 and schematically representing an airflow device 400, according to one example of the present disclosure.

In some examples, airflow device 400 comprises at least some of substantially the same features and attributes as one or several of the airflow devices as previously described in association with at least FIGS. 1-5. In some examples, airflow device 400 comprises one example implementation of an airflow device as previously described in association with at least FIGS. 1-5. As in previously described examples, in at least some instances, like reference numerals refer to like elements.

As shown in FIG. 6, in some examples airflow device 400 comprises a housing 422 at least partially enclosing a fan, including a motor M and an impeller 446. At least a portion of impeller 446 is further represented via fans F. Motor M causes rotation of fins F of impeller 446, which acts as a centrifugal pump to create positive pressure P downstream from fins F and a slight negative pressure N upstream from fins F of impeller 446, such as just outside the exit ports 462A, 462B. In one aspect, via exit ports 462A, 462B this negative pressure N draws ambient air 499 as a second airflow AF2 into second portion 444 and through gaps 460A, 460B alongside motor M to convectively cool motor M. In some examples, the positive pressure P is 0.5 inch H2O and the negative pressure N is 0.2 inch H2O.

In some examples, housing 422 comprises an array of walls 426, 480, 483, 486. Wall 480 includes first portion 481A, second portion 481B, and third portion 451A, 451B while wall 483 comprises first portion 484A and second portion 484B.

As previously described in association with at least FIGS. 1-5, when driven via motor M, the fins F of impeller 446 causes a pressurized airflow AF1 within housing 422 to result in the first airflow AF1 to flowing through and out of nozzles 470 in first wall 426 to contact a media (32 in FIG. 1) passing by first wall 426. After contacting the printed media and via the pressure differential created via the centrifugal action of impeller 446, the returning portion 431 of first airflow AF1 is drawn into at least a return duct 479 formed between wall portions 481A and 484A and through which the first airflow AF1 travels until portion 432 of first airflow AF1 passes by heater H between wall portions 484B and 481B. As represented by directional arrow 433, the first airflow AF1 continues to be drawn by impeller 446 until the first airflow AF1 arrives external to fins F of impeller 446 at positive pressure zone P.

As shown in FIG. 6, a first end E1 of the respective impeller fins F is bounded by a wall 492 of an impeller assembly 490 while a second end E2 of the respective impeller fins F is bounded by wall 484B. This arrangement effectively creates a seal such that upon rotation of the fins F of impeller 446, the first airflow AF1 flows from an intake side 438 to an output side 439 of the fins F of the impeller 446, as represented by directional arrow 433. From output side 439 of fins F of impeller 446, the first airflow AF1 moves outward and is guided via walls 486 and first portion 484A of wall 483 until the positive pressure forces the air out nozzles 470 in first wall 426 to contact printed media 32 passing by and over first wall 426. In at least this context, it will be understood that the first airflow AF1 leaving output side 439 of fins F incorporates the below-described second airflow AF2 present at exit ports 462A, 462B.

Meanwhile, the negative pressure N created by fins F of impeller 446 pulls ambient air 499 from outside the housing 422 into the recess 445 of second portion 444 to pass by the back end E2 of motor M, and along the sides S1, S2 of motor M (through gaps 460A, 460B) to create a second airflow AF2, which later exits through ports 462A, 462B to join (e.g. be incorporated within) portion 433 of first airflow AF1 being pulled through fins F of impeller 446.

As further shown in FIG. 6, the shaft 496 of motor M extends into at least wall 491 of impeller assembly 490, while being secured relative to wall 491 to thereby translate the rotary motion of shaft 496 into rotary motion of wall 491 and impeller fins F. In some examples, the impeller assembly 490 includes an upper wall 494 and top plate 497. In some examples, the upper wall 494 may act as an air dam to influence the path of the first airflow AF1. Accordingly, the shape and/or size of upper wall 494 may take a variety of forms in order to achieve a desired path of airflow AF1.

In some examples, the second portion 444 of housing 422 comprises an at least partially cylindrical shape, which in turn includes a sidewall 451A, 451B having a length (D1) generally equal to or greater than a length (L1) of motor M. In some examples, the sidewall has a length less than a length of the motor M.

In some examples, the second portion 244 defines a recess 445 sized and shaped to at least partially enclose the motor M with the recess 445 having a depth D1 (e.g. length) greater than a length (L1) of the motor. In some examples, the open end of the second portion 444 may sometimes be referred to as a mouth 443 or opening of the recess 445.

In some examples, the second portion 444 of housing 422 is sized and shaped relative to motor M such that an end E2 of motor M does not protrude beyond a plane of a back wall 424 of the housing 422. Accordingly, in some instances, motor M may be referred to as being within the general volume defined by housing 422, even though motor M is exposed to ambient air 499.

In some examples, the motor M is located centrally within an interior space defined by an inner edge 438 of the respective fins F of the impeller 446 and spaced apart from an inner edge 438 of the respective fins F of the impeller 446. In some examples, the motor M may be sometimes be referred to as being nested within the interior portion of, or relative to, the impeller 446. With this in mind, in some examples a length (L1) of the motor is generally co-extensive with at least a majority of a length (L2) of the respective fins F of the impeller 446.

In some examples, the path at least partially defined by portions of housing 422 through which the first airflow AF1 moves may sometimes be referred to as a first path 510. In some examples, the path at least partially defined by portions of housing 422 and motor M through which the second airflow AF2 moves may sometimes be referred to as a second path 520.

It will be further understood that while the housing 422 (which at least partially encloses the motor M and impeller F) comprises a generally rectangular-shaped block, at least the walls (e.g. 426, 480, 483, 486, etc.) are shaped, sized, and spaced to such that the first and second paths 510, 520 defined by the housing 422 are configured to complement the generally circular/radial centrifugal action of the impeller 446.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. A device comprising:

a motor to drive an impeller to cause a first airflow and a second airflow;

a housing at least partially enclosing the motor and impeller, and defining at least:

a first path to recirculate the first airflow in a first temperature range;

a second path to receive the second airflow, at a second temperature less than the first temperature range, to travel alongside the motor;

a first wall along the first path and including a nozzle array through which the first airflow is to be forced via the impeller to contact printed media external to the first wall; and a second wall extending between the motor and the impeller and including at least one port through which the second airflow is to exit to join the first airflow adjacent the impeller, the first airflow and the second airflow to travel in a same direction along opposite sides of the second wall.

2. The device of claim 1, wherein the first path comprises a heater.

3. The device of claim 1, wherein the impeller comprises the sole impeller of the airflow device.

4. The device of claim 3, wherein the motor comprises the sole motor of the airflow device.

5. The device of claim 1, wherein the second temperature is an ambient temperature, and the first temperature range is above the ambient temperature.

6. The device of claim 1, wherein the second wall separates the motor from the impeller.

7. The device of claim 1, wherein the second wall comprises a generally cylindrical shape to define a recess within which the motor is at least partially enclosed, and wherein the at least one port is located adjacent a closed first end of the recess generally opposite an open second end of the recess.

8. The device of claim 1, wherein the second airflow is to travel alongside the motor between the motor and the second wall.

9. A device comprising:

an image formation mechanism; and a dryer downstream a media path from the image formation mechanism and comprising:

a motor to drive an impeller to cause a first airflow and a second airflow; and a housing at least partially enclosing the motor and impeller, and defining at least:

a first heated path by which the first airflow is to recirculate and be heated;

a first wall with a nozzle array through which the first airflow is to pass to contact printed media external to the first wall;

a second wall separating the motor from the impeller along which the first airflow is to travel in a first direction; and a second non-heated path by which the second airflow is to travel in the first direction alongside the motor between the motor and the second wall and exit through at least one port to join the first airflow at the impeller, wherein the first airflow and the second airflow are to travel along opposite sides of the second wall.

10. The device of claim 9, wherein the second wall includes the at least one port.

11. The device of claim 9, wherein the impeller comprises a centrifugal pump including an intake side and an output side, and wherein the at least one port is located at the intake side in a negative pressure region.

12. The device of claim 9, wherein the image formation mechanism comprises a fluid ejection assembly.

13. A dryer downstream a media path from an inkjet print mechanism, the dryer comprising:

a single motor to drive a single impeller to cause a first airflow and a second airflow; and a housing comprising:

a first portion at least partially enclosing the single impeller and through which the first airflow is to recirculate and be heated, the first portion including a first wall with a nozzle array through which the first airflow is to pass to contact printed media passing external to the first wall; and a second portion at least partially enclosing the single motor separately from the single impeller and through which the second airflow is to travel alongside the motor, the second portion including a second wall with at least one port through which the second airflow joins the first airflow adjacent the impeller within the first portion, wherein the first airflow is to travel in a first direction along a first side of the second wall and the second airflow is to travel in the first direction along a second side of the second wall between the motor and the second wall opposite the first side.

14. The dryer of claim 13, wherein the second portion defines a recess having a depth at least equal to or greater than a length of the motor, with a first end of the motor fixed in a closed first end of the recess and an opposite second end of the motor adjacent an open second end of the recess.

15. The dryer of claim 14, wherein the at least one port is located adjacent the closed first end of the recess.

16. The dryer of claim 14, wherein the recess comprises an at least partially cylindrically shaped wall, which is common to both the first portion and the second portion of the housing.

17. The dryer of claim 13, wherein a temperature of the second airflow is less than a temperature of the first airflow.

18. The dryer of claim 17, wherein the temperature of the second airflow is an ambient temperature.

* * * * *